United States Patent [19]

Domingos

[11] 4,047,650

[45] Sept. 13, 1977

[54] SPORTSMAN'S MULTIPURPOSE UTILITY POUCH

[76] Inventor: John M. Domingos, 3108 Vassar St., Bakersfield, Calif. 93306

[21] Appl. No.: 671,027

[22] Filed: Mar. 29, 1976

[51] Int. Cl.[2] ..... F41B 13/04; F42B 39/08

[52] U.S. Cl. ..... 224/2 B; 224/21; 224/26 R

[58] Field of Search ..... 224/2 B, 1 R, 13, 19, 224/17, 21, 5 C, 2 D, 2 E, 22, 23, 5 A, 5 R, 26 R, 26 B, 27, 26 D, 26 K, 26 H

[56] References Cited

U.S. PATENT DOCUMENTS

| | | | |
|---|---|---|---|
| 109,365 | 11/1870 | King | 224/21 |
| 926,402 | 6/1909 | Geissler | 224/26 C |
| 1,781,816 | 11/1930 | Jovino | 224/23 |
| 2,324,154 | 7/1943 | Haney | 224/23 X |

FOREIGN PATENT DOCUMENTS

| | | | |
|---|---|---|---|
| 725,376 | 8/1942 | Germany | 224/2 B |

*Primary Examiner*—Robert J. Spar
*Assistant Examiner*—Jerold M. Forsberg
*Attorney, Agent, or Firm*—Dennis B. Haase

[57] ABSTRACT

A sportsman's multipurpose utility pouch of unitary construction adapted to be worn on the user's belt and comprising cartridge and accessory sections and an optional knife sheath having a safety flap to secure a hunting knife or the like in a safe but readily accessible position when not in use. The cartridge sections comprise a plurality of fitted pockets for receipt of live ammunition in frictional holding engagement to secure the same from inadvertent falling from the pockets, said cartridge sections being foldable in safety engagement when not in use. Also included are additional accessory pockets formed contiguously with said cartridge pockets for holding documents or the like, such as hunting licenses and deer tags.

3 Claims, 9 Drawing Figures

FIG. 1.
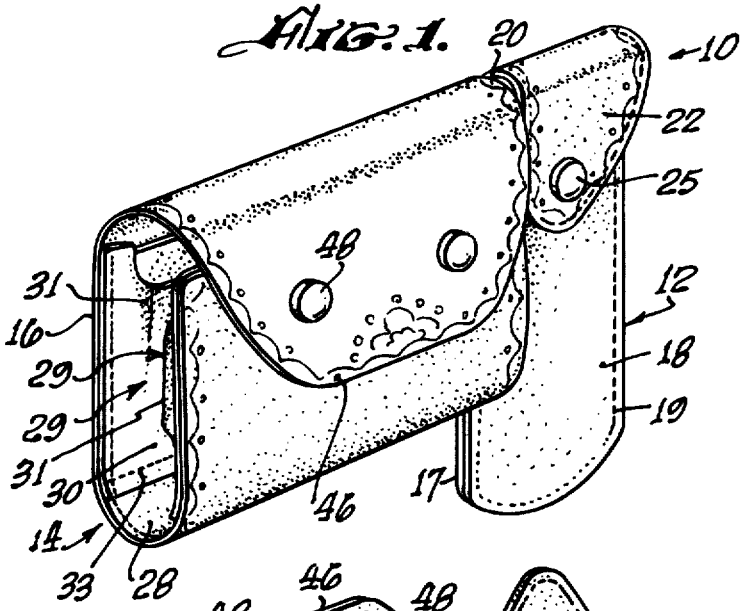
FIG. 2.
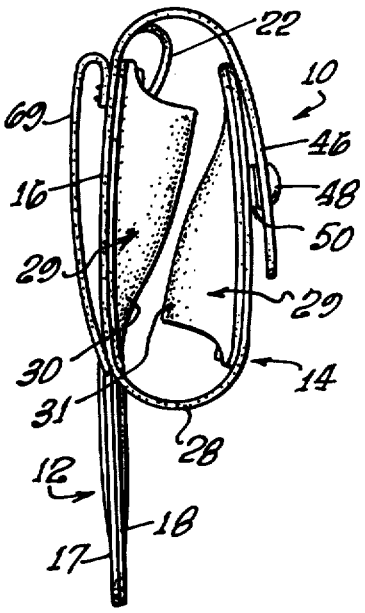
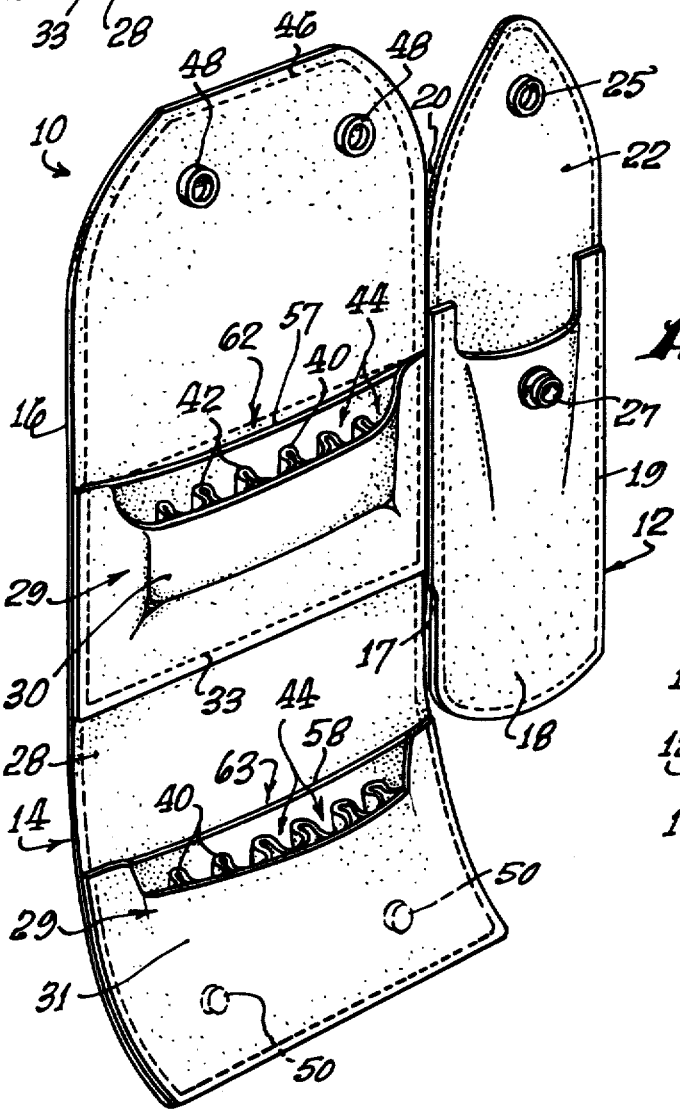
FIG. 4.
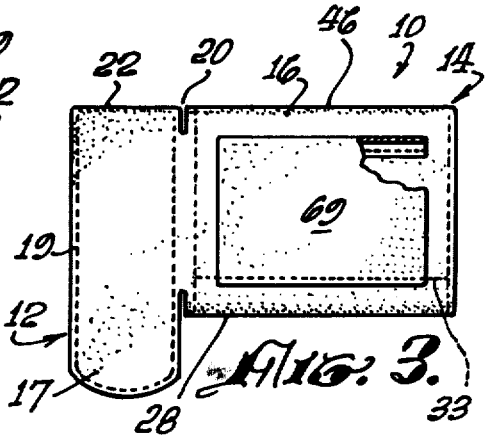
FIG. 3.

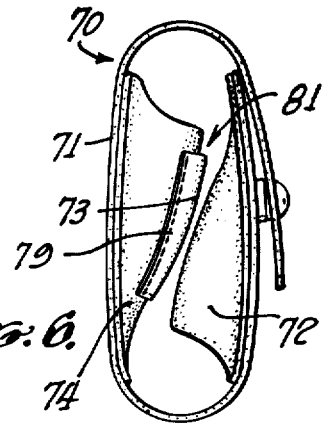
FIG. 6.
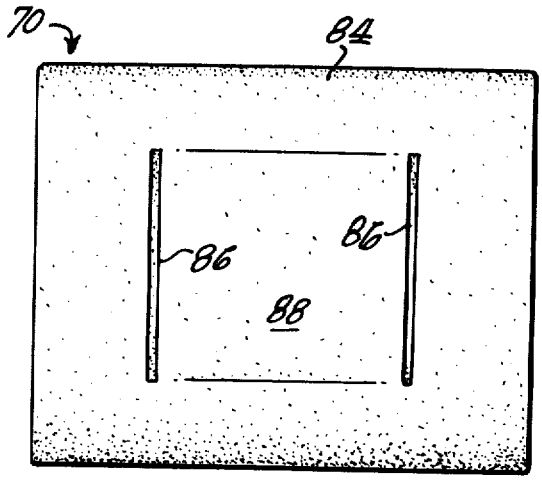
FIG. 7.
FIG. 5.
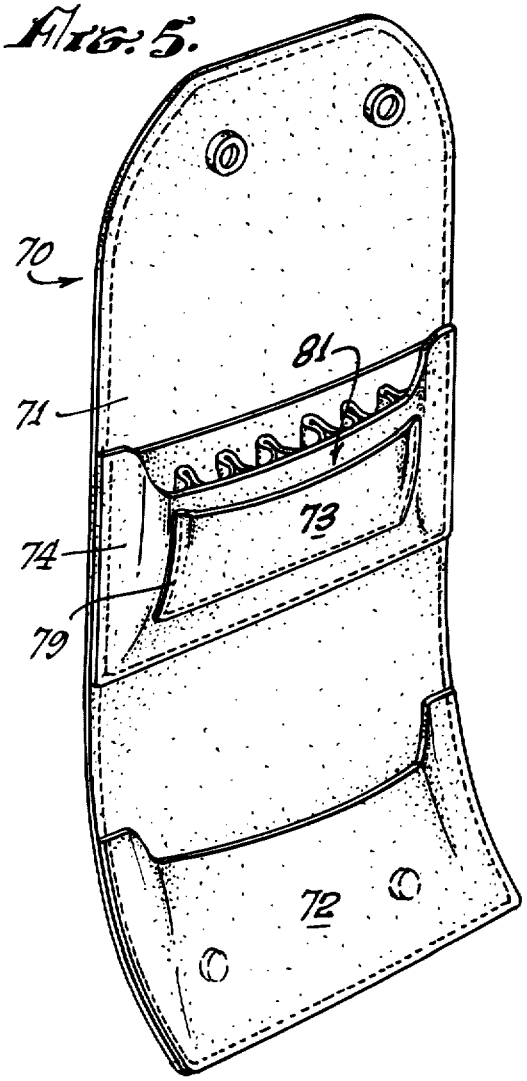
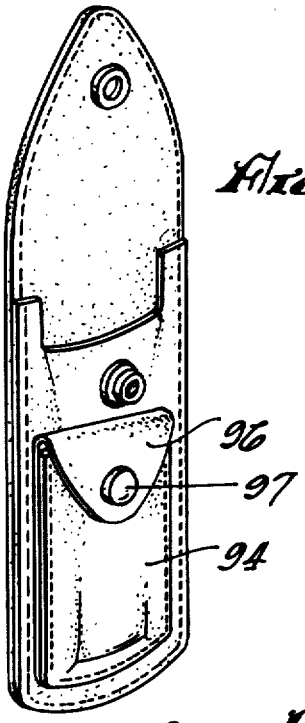
FIG. 9.
FIG. 8.
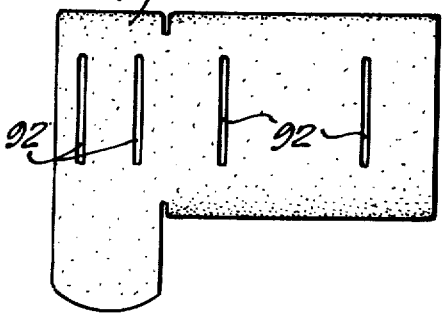

SPORTSMAN'S MULTIPURPOSE UTILITY POUCH

BACKGROUND OF THE INVENTION

Until the advent of the present invention, sportsmen, and in particular hunters, typically wore specially made vests and/or cartridge belts in order to transport such necessaries as ammunition and knives for hunting or skinning. These articles of clothing were just that, and served the primary purpose of providing warmth or holding up the wearer's pants. During those periods when the sportsman was not actively engaged in pursuit of his sport, he nonetheless wore those articles of clothing to achieve their primary purpose and often, therefore, carried live ammunition or a knife around with him. Both posed a nuisance and a potential, but unnecessary, danger. Moreover, cartridge belts typically left the primer or percussion cap facing upwardly and usually fully exposed. Vests either had external loops for cartridges or, at best, covered the cartridges themselves with relatively flimsey material, such as canvas duck, which was never intended to and could not be expected to absorb, spread or withstand sharp impact. Thus, such articles of clothing placed the user in the posture of carrying live ammunition in a position which exposed his person to danger of inadvertant impact and possible discharge of a cartridge and unless the wearer chose to remove the ammunition and place it elsewhere except when actively engaged in hunting pursuits, his exposure to such dangers was continuous as long as he wore the aforementioned articles. Still another disadvantage of loop storage is found in an accumulation of dirt and grit on cartridge surfaces which adversely effects "chambering" of shells and requires frequent cleaning of weapons.

The present invention provides a unique means of carrying ammunition and related hunting equipment in the form of a vastly improved accessory pouch which may be worn selectively and with a high degree of safety in that its construction inherently protects live ammunition from inadvertent impact which might result in discharge, and because it is an accessory constructed to be worn on the user's belt, it may be removed conveniently and stored with ammunition intact safely when the sportsman is not actively engaged in hunting pursuits.

Thus, the accessory pouch provides a high degree of safety as compared to more conventional and better known vests and cartridge belts and separate knife sheaths, and further provides the added convenience of selective use in that it is capable of being worn on the belt when needed and quickly removed from the belt when not in use, thereby eliminating the problem of having to carry live ammunition on one's belt during periods when the user is not engaged in a hunting activity. Moreover, as previously pointed out, the foldability feature has the multiple advantage of protecting the cap and primer of any live cartridges against inadvertent impact which might cause a shell discharge, storing and maintaining the cartridges relatively free of dirt and grit, while at the same time permitting ready access to cartridges by the user when, and only when, desired.

In summary, the present invention provides a unique accessory, being particularly useful to the full spectrum of sportsmen from hunters to competition target shooters, having highly desirable safety features not found in prior devices and permitting the user to carry such items as a sharp knife and live cartridges in a single compact unit only when such items are needed in actual use and to remove and safely store the same when not needed without having to remove or exchange a belt or vest or other multipurpose article of clothing customarily used for carrying such hunting accessories. The present invention thus provides optimum practical use of existing clothing without sacrifice of the convenience of having necessary equipment available when, but only when, required and in relative complete safety.

BRIEF DESCRIPTION OF THE DRAWING:

The features of the present invention may be more readily understood by reference to the accompanying drawings, wherein:

FIG. 1 is a perspective view of the accessory pouch of the present invention shown in its closed and safety secured position;

FIG. 2 is a side elevation of the pouch shown in FIG. 1 and illustrating the inter-relationship of the various pockets and belt loop;

FIG. 3 is a rear view of the accessory pouch of the preferred embodiment of FIG. 1, illustrating certain additional features of the construction of the pouch;

FIG. 4 is a perspective view of the pouch of FIG. 1 shown with its accessory pouch open for receipt and removal of the accessories intended to be secured therein;

FIG. 5 is a perspective view of a modified form of the accessory pouch of the present invention;

FIG. 6 is a side elevation of the pouch shown in FIG. 5 and illustrating the inter-relationship of the various elements in their safety secured position;

FIG. 7 is a rear elevation of the modified form of the pouch shown in FIG. 5 illustrating an alternative arrangement for securing the pouch to the wearer's belt;

FIG. 8 is a rear elevation of a pouch constructed as in FIG. 4, but illustrating the modified arrangement of FIG. 7 securing the pouch to the wearer's belt; and FIG. 9 is a view of a modified form of the knife sheath portion of the present invention illustrating a refinement thereof.

DESCRIPTION OF THE PREFERRED EMBODIMENT

Having thus outlined various features of the present invention and placed it within the environment of the existing art, the preferred embodiment illustrated in FIGS. 1 through 4 of the drawings may be described as follows:

Referring initially to FIG. 1 there is shown a preferred embodiment of the present invention comprising a sportsman's multipurpose utility pouch indicated generally at 10 which combines a safety knife sheath generally indicated at 12 and a cartridge retainer section 14.

The pouch, which is constructed of a pliable material of high wearability and strength, such as, for example, leather, also has in its present use the characteristics of being foldable or bendable while at the same time being sufficiently resistant to impact or shock as to provide protection against inadvertent or accidental discharge of live ammunition.

In construction of the preferred embodiment illustrated, a unitary backing panel 16 is provided which defines the overall shape and dimension of the pouch and in this preferred embodiment, further includes an integrally formed base portion 17 for receipt of sheath panel 18, secured thereto as by stitching 19. The panel 18 thus secured to base portion 17 defines a pocket for receipt of a hunting knife or the like.

The backing panel is partially severed to define a cut as at 20 so as to give definition to a knife safety flap 22, operable in conjunction with the sheath panel 18, and having sufficient size to encircle protruding parts or portions of the handle of a hunting knife disposed in the pocket. The safety flap is fitted with suitable means for fastening the flap to close the pocket and in the illustrated case, the fastener means includes a known form of a snap fastener having, as illustrated, a female portion 25 disposed on the flap 22 and adapted to engage a complimentary male portion 27 appropriately located on the face of the sheath panel. The snap fastener illustrated provides a good safety closure. It will be appreciated, however, that other fastener means may be employed without departure from the invention so long as the closure provides adequate safety, without significant impairment of ready access.

In keeping with a principal aspect of the invention as illustrated particularly in FIG. 4, the backing panel 16 includes an elongated portion 28 adjacent the sheath section, in order to form a base or backing for the construction of a series of ammunition pockets 29. Thus, a series of ammunition pockets 29 are provided by affixing substantially identical transverse panels 30 and 31 respectively to the backing panel ad seriatim. The transverse panels 30 and 31 are conveniently secured to the backing panels such as by stitching 33, and in such a position as to cause the pockets 29 to open upward when the pouch is disposed on the user's belt.

A novel feature of the invention is the capacity of the pouch to secure an appropriate number of cartridges in a safe but readily accessible manner. To this end, an elongated transverse cartridge gripping strip 40 is provided. The strip 40 is intermittently stitched or otherwise fastened as at 42 to form a series of convolutions or loops indicated generally at 44, each of which defines a single cartridge retaining receptacle of such size and shape as to frictionally engage and secure an individual cartridge or shell in discreet spaced relation with a portion thereof extended in such a manner as to permit its easy removal from the pocket for use while at the same time providing sufficient side wall frictional engagement to preclude its being inadvertently dropped from the pocket. In this manner, a number of shells may be carried safely while at the same time being readily accessible for quick and efficient use. Cartridge storage in this manner has still another advantage, and that is that the completely encased cartridges are retained in a relatively dust and grit free manner. Indeed, insertion and removal of cartridges results in a wiping action of the side walls against the strip 40. Thus, the consequences of dirty cartridges is minimized.

As best illustrated in FIGS. 2 and 4, a portion of the backing panel upon which the cartridge holding pockets are mounted are of sufficient longitudinal dimension and constructed of such material, preferably leather, as to permit the lower pocket defined by transverse panel 31 to be folded against the upper pocket defined by the transverse panel 30 in face to face relation. In this manner the preferred embodiment defines a compact and convenient carrying position for live ammunition as best illustrated in FIG. 2. There is also defined, by the backing panel, a flap portion 46 which is of sufficient length as illustrated in FIG. 2, to partially encircle the cartridge pockets in their folded position, thereby adding further to the security of the pouch. Fastener means are provided such as the well known female snap fastener members 48 on the flap with associated male snap members 50 located on the under side of the backing panel 16 as illustrated in FIG. 4. Thus, the cartridge pockets are capable of being secured in the closed or transportation position by convenient safety snap devices such as those illustrated.

Further utility is provided by the inclusion of intermediate cartridge panels 57 and 58 disposed respectively between panels 30 and 31 and the backing panel 16 are provided. The cartridge panels have essentially the same profile as the panels 30 and 31 and are assembled therewith as by the stitching at 33 to thereby fasten the same along with the transverse panels 30 and 31 respectively to the backing panel. As a result, the pockets defined between the transverse panels and the backing panel are bifurcated.

In order to permit ready removal and storage of the pouch when not in use and convenient placement when in use, a belt loop 69 is provided to permit the pouch 14 to be selectively worn on the user's belt.

It will be observed, particularly in FIG. 4, that while the intermediate cartridge panel provides a convenient base for the formation of cartridge pockets, they have the added salutary effect of forming discrete compartments 62 and 63 for receipt of such documentary materials as may be necessary and appropriate to the hunter's activity, among them being a hunting license and such materials as deer tags.

With particular reference now to FIGS. 5 through 9, certain modified forms of the preferred embodiment are there illustrated. In particular, FIGS. 5, 6 and 7 illustrate an accessory pouch denominated 70 which is constructed without the knife sheath which was otherwise formed integrally with the preferred embodment. Such a pouch has particular, although not exclusive, utility in connection with competition and target shooting where an accompanying knife sheath is of little or no value. The pouch 70 may be constructed in two basic configurations, the first of which is essentially the same as that of the preferred embodiment identified at 14 wherein two cartridge pockets are provided. No detailed description of that arrangement, therefore, will be provided. An alternative is contemplated, however, without departure from the invention, which results from the modification of one of the cartridge pockets, such as by removal of the cartridge gripping strip illustrated in the FIG. 4 embodiment so as to provide an open pocket formed by a panel 71 which is stitched or otherwise attached to the backing member 72. It is contemplated that this pocket may be used by the sportsman for carrying the minimum essentials for survival in the wilderness such as, for example, a snake bite kit. In this manner, the pouch is capable of servicing the additional needs of the sportsman.

In addition to the foregoing, a further modification is illustrated wherein a transverse strip 73 is sewn to the outer face of the transverse panel 74 which forms the cartridge pocket with the backing member 72. The panel 73 is sewn to the transverse panel 74 as at 79 along three edges in order to provide an opening at 81 facing upwardly towards the wearer, thus providing an additional pocket for whatever purposes are deemed most appropriate.

FIGS. 7 and 8 illustrate a modified form or arrangement for securing the pouch to the wearer's belt. In the FIG. 7 embodiment, an additional panel 84 is secured to the back side of the pouch and is provided with slots 86 through which the wearer's belt might be slipped so as to engage the pouch between the backing panels in the area shown at 88. Similarly, FIG. 8 illustrates the same arrangement with respect to the preferred embodiment of FIG. 4, which includes the knife sheath and in that instance, a second back panel 90 having slots 92 therein provides a convenient arrangement for engagement of the user's belt for selective wearing of the pouch.

In still another modified form, a knife sheath portion is illustrated at FIG. 9 which includes a pocket 94 formed on the sheath panel and having a flap 96 with a fastener arrangement 97 disposed thereon to close the pocket. This pocket is provided for the purposes of carrying a whet stone or other sharpening device thereby further enhancing the utility of the pouch itself.

It will be readily apparent from the foregoing, that the present invention provides a unique multipurpose hunting accessory pouch which provides optimum safety and convenience to the hunter and is transportable at the hunter's discretion.

Having thus described the preferred embodiment of my invention, I claim the following:

1. A sportman's multipurpose utility pouch adapted to be transported on the user's belt, comprising a unitary backing panel having formed thereon the combination of a knife sheath section and an ammunition section disposed immediately adjacent thereto, a sheath panel fastened to said backing panel to define a knife pocket, a portion of said backing panel above said knife sheath panel defining a safety flap disposed thereabove and being foldable into selective engagement with said sheath panel to secure a hunting knife or the like nested therein, said ammunition section comprising a series of longitudinally spaced pockets, each said pocket being formed by means of a number of contiguous intermediate panels being secured to one another along three peripheral edges thereof and to said backing panel thereby defining with said backing panel adjoined upwardly opening enclosures; means provided in one of said adjacent enclosures sandwiched between adjacent ones of said intermediate panels for securing ammunition in discreet spaced relation causing said ammunition to be securely nested between said adjacent panels except that a small portion thereof extends beyond said means to thereby permit handling of said ammunition, said backing panel extending beyond said pockets to thereby provide a closure flap, said backing panel being foldable between said pockets to thereby bring said pockets into protective face to face juxtaposition; and said backing panel having fastening means disposed thereon and located such that when said pockets are folded into juxtaposition said flap may be folded over said pockets and fastened to protect the contents of said pockets.

2. The pouch as set forth in claim 1 wherein a transverse strip is secured to said intermediate panel intermittently such as to form a series of loops of such dimensions as to receive cartridges in functional holding engagement in the area defined between the said intermediate and said transverse panels.

3. The pouch as set forth in claim 1 wherein means defining a closeable pocket is secured to the outer surface of one of said transverse panels for receipt of accessories.

* * * * *